US008262405B1

(12) United States Patent
Bishop

(10) Patent No.: US 8,262,405 B1
(45) Date of Patent: Sep. 11, 2012

(54) WIRE-TO-WIRE CONNECTOR

(75) Inventor: Peter Bishop, Cambs (GB)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 13/048,186

(22) Filed: Mar. 15, 2011

(51) Int. Cl.
*H01R 4/24* (2006.01)

(52) U.S. Cl. ..... 439/439

(58) Field of Classification Search ..... 439/439, 439/440, 441, 268, 709
See application file for complete search history.

(56) References Cited

U.S. PATENT DOCUMENTS

| | | | | |
|---|---|---|---|---|
| 3,152,851 | A * | 10/1964 | McLaughlin | 439/441 |
| 3,474,389 | A * | 10/1969 | Nagano | 439/440 |
| 3,989,346 | A | 11/1976 | Manning | |
| 4,149,768 | A | 4/1979 | Wise | |
| 4,295,698 | A | 10/1981 | Chow | |
| 4,684,195 | A | 8/1987 | Anderson et al. | |
| 4,759,726 | A * | 7/1988 | Naylor et al. | 439/441 |
| 4,768,976 | A * | 9/1988 | Gelati | 439/441 |
| 5,083,944 | A | 1/1992 | Self, Jr. | |
| 5,087,210 | A | 2/1992 | Myers et al. | |
| 5,429,526 | A | 7/1995 | Ann | |
| 5,445,528 | A | 8/1995 | Frantz | |
| 5,449,300 | A * | 9/1995 | Yoon | 439/441 |
| 5,685,735 | A * | 11/1997 | Hohorst | 439/441 |
| 5,915,991 | A * | 6/1999 | Roman | 439/441 |
| 6,146,187 | A * | 11/2000 | Pallai | 439/441 |
| 6,250,950 | B1 * | 6/2001 | Pallai | 439/441 |
| 6,666,707 | B2 * | 12/2003 | Moret Codina | 439/441 |
| 6,712,641 | B2 * | 3/2004 | Beege et al. | 439/441 |
| 6,746,286 | B2 * | 6/2004 | Blaha | 439/787 |
| 6,981,890 | B2 * | 1/2006 | Cutler et al. | 439/441 |
| 7,004,781 | B2 * | 2/2006 | Walter | 439/441 |
| 7,094,094 | B2 * | 8/2006 | Zahnen et al. | 439/521 |
| 7,114,986 | B1 * | 10/2006 | Toly | 439/441 |
| 7,118,427 | B2 * | 10/2006 | Zahnen et al. | 439/798 |

(Continued)

FOREIGN PATENT DOCUMENTS

DE 19 18 193 A1 10/1970

(Continued)

OTHER PUBLICATIONS

EP Search Report, May 23, 2012.

*Primary Examiner* — Amy Cohen Johnson
*Assistant Examiner* — Vladimir Imas
(74) *Attorney, Agent, or Firm* — Dority & Manning, P.A.

(57) ABSTRACT

A wire-to-wire electrical connector includes an insulative body member and an internal connector position. A wire insertion opening is defined in each end wall of the body member at the connector position. A first contact element is disposed in the connector position coaxial with the wire insertion openings and includes opposite end portions with a respective contact tab configured thereon. The contact tabs are biased to a closed position across the respective wire insertion opening. An actuator is configured with each wire insertion opening. The actuators are movably displaceable through an opening in a wall of the body member and include an engagement end in contact with a respective end portion of the first contact element. The actuators are manually depressible to move the contact tabs to an open position for insertion of a conductive core of a wire into the wire insertion opening beyond the contact tab, whereby upon release and return of the actuators, the contact tabs are biased against the conductive cores of opposite wires.

18 Claims, 5 Drawing Sheets

U.S. PATENT DOCUMENTS

| | | | | |
|---|---|---|---|---|
| 7,144,279 | B2 * | 12/2006 | Zahnen et al. | 439/709 |
| 7,320,616 | B1 | 1/2008 | Legrady et al. | |
| 7,578,682 | B1 * | 8/2009 | Hughes et al. | 439/89 |
| 7,645,158 | B2 * | 1/2010 | Mulhouse et al. | 439/441 |
| 7,717,740 | B2 * | 5/2010 | Zahnen et al. | 439/521 |
| 7,722,384 | B2 * | 5/2010 | Breen, IV | 439/441 |
| 7,794,268 | B2 * | 9/2010 | Breen et al. | 439/441 |
| 7,867,013 | B2 | 1/2011 | Cox et al. | |
| 2001/0010981 | A1 * | 8/2001 | Cutler et al. | 439/441 |

FOREIGN PATENT DOCUMENTS

| | | | |
|---|---|---|---|
| EP | 1 045 475 | A2 | 10/2000 |
| EP | 1 309 036 | A1 | 5/2003 |
| EP | 1 883 132 | A1 | 1/2008 |
| GB | 2 127 627 | A | 4/1984 |
| GB | 2 193 852 | A | 2/1988 |

* cited by examiner

WIRE-TO-WIRE CONNECTOR

FIELD OF THE INVENTION

The present invention relates generally to the field of electrical connectors, and more particularly to a wire-to-wire connector used to connect wires together in a coaxial configuration.

BACKGROUND

Various types of wire-to-wire connectors are known in the art for forming electrical connections between the terminal ends of separate wires. A simple type of connector used for this purpose is a butt or splice connector used for forming a permanent splice or connection between wires. There are, however, many applications wherein permanent connections between the wires are not desired or practical and, in this regard, various releasable connectors have been developed.

For example, U.S. Pat. No. 5,083,944 describes a wire-to-wire connector assembly employing a press fit between a blade terminal crimped onto one wire and a receptacle terminal crimped onto the other wire. The terminals are, in turn, received in respective insulative housings that engage and latch when the components are pressed into electrical contact. Various commercially available connectors of this type are readily available, for example the family of SL™ (Stackable Linear) connectors from Molex. These connectors are, in certain instances, disadvantageous in that they require numerous processing/assembly steps to mount the respective headers or housings (with internal connector terminals) onto the ends of the wires. Also, when connected and latched together, the housings tend to occupy a relatively large space, which can be detrimental in certain applications.

Single housing wire-to-wire connectors have also been proposed. For example, U.S. Pat. No. 7,867,013 describes an in-line IDC (insulation displacement connector) splice connector having a housing with an internal cavity in which is seated the IDC element. The body has opposite ends with wire guides to receive and guide wires to the IDC element. Caps are pivotally mounted to the connector body, wherein upon closing the caps the wires are engaged by the IDC element and spliced together. U.S. Pat. No. 4,684,195 describes another type of single-body, in-line IDC splice connector.

The present invention provides an alternate in-line splice connector that is relatively simple, provides a secure electrical connection, and allows for easy insertion and withdrawal of the wires without the need of tooling.

SUMMARY

Objects and advantages of the invention will be set forth in part in the following description, or may be obvious from the description, or may be learned through practice of the invention.

In accordance with aspects of the invention, a wire-to-wire electrical connector is provided that is particularly well suited for connecting or splicing the stripped terminal ends of coaxially aligned wires. It should be appreciated that connectors according to the invention are not limited to any particular use, and may be used in any application wherein a secure electrical connection is desired between wires or other conductors.

The connector includes a body member (also referred to in the art as a "molding") formed from any conventional insulator material. The body member can take on various shapes and sizes, but generally includes top and bottom walls, side walls, and opposite end walls. In a particular embodiment, the body member is generally box-shaped. A connector position is disposed between the end walls, and a wire insertion opening is defined in each of the end walls such that at least one pair of the wire insertion openings is provided for each connector position to connect at least two separate wires. A first contact element is disposed in the connector position coaxial with the wire insertion openings. In a particular embodiment, the body member comprises an upper shell member and a lower shell member, with the first contact element pressed into the lower shell member.

The first contact element generally has opposite end portions with a respective contact tab configured thereon, the contact tabs biased to a closed position across the respective wire insertion opening.

An actuator is configured with each wire insertion opening. The actuators are movably displaceable through an opening in a wall of the body (e.g., the top wall) and include an engagement end in contact with a respective end of the first contact element. The actuators are depressible (manually or with a tool) to move the contact tabs to an open position for insertion of a conductive core of a wire into the wire insertion opening beyond the contact tab, whereby upon release and return of the actuators, the contact tabs are biased against the conductive cores of the wires and the first contact element defines a conductive bridge between the terminal ends of the coaxially aligned wires.

The contact element may have various shapes or configurations. In one embodiment, the first contact element is a generally C-shaped member with an elongated bottom section and bent over, biased end portions. The contact tabs may be formed at or adjacent to terminal ends of the bent over end portions. For example, the contact tabs may simply be a section of the bent over end portions. In another embodiment, the contact tabs may be defined by angled cut-outs of the bent over end portions that extend at an angle above a plane of the end portion. These cut-outs may be in the terminal end of the end portions or spaced from the terminal ends. With this embodiment, the engagement end of the actuators may engage the first contact element adjacent to the angled cut-outs, for example at a terminal end section of the contact element, or on opposite sides of the cut-out.

The engagement end of the actuators may have a recess disposed for receipt of the conductive core of the wire in the connected state with the connector. The recess may further define a stop surface against which a terminal end of the conductive core of the wire abuts in the connected state.

In a particular embodiment, the contact tabs are positioned to block passage of the conductive core of the wire further into the wire insertion opening until the contact tab is moved to an open position below the conductive core upon depression of the respective actuator.

In a particularly unique embodiment, the connector further includes a second contact element fixed in the body member at the connector position so as to bridge between the contact tabs of the first contact element. Thus, in the closed position, the contact tabs are biased against the second contact element. In the connected state, the conductive cores of the wires are in conductive contact with the second contact element as well, the second contact element thereby providing an additional conductive path between the opposite wires.

In still a further embodiment, the connector is configured as a multi-way connector with a plurality of the first contact elements and associated pairs of wire insertion openings and actuators, whereby multiple pairs of wires may be connected via the connector. The plurality of first contact elements may be electrically isolated from each other such that multiple pairs of connected wires are isolated from each other.

In an alternative embodiment, the multi-way connector may be configured as a shorting block wherein the plurality of first contact elements are electrically shorted together. With this configuration, any one wire connected to the connector is electrically connected to all other wires connected to the connector.

The multi-way connector may also include a plurality of second contact elements fixed in the body member at the different connector positions, with the second contact elements bridging between the contact tabs of the first contact elements. With this configuration, in the closed position the contact tabs are biased against the second contact element, and in the connected state the conductive core of the wires are in conductive contact with the second contact elements. The second contact elements may be electrically shorted together in the shorting block configuration of the connector discussed above.

Particular embodiments of the unique wire-to-wire connector in accordance with aspects of the invention are described in greater detail below by reference to the examples illustrated in the drawings.

DETAILED DESCRIPTION

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present invention encompass these and other modifications and variations as come within the scope and spirit of the invention.

Figure 1:
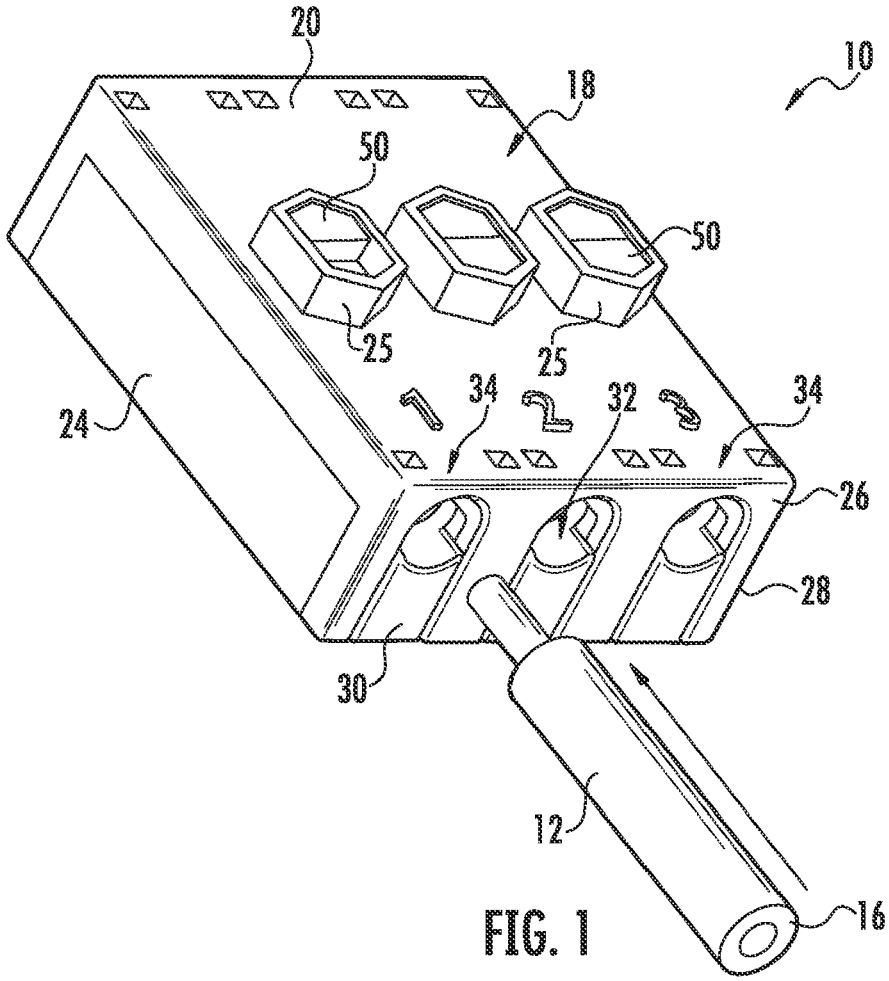
FIG. 1 is a perspective view of an embodiment of a connector according to aspects of the invention.
Figure 2:
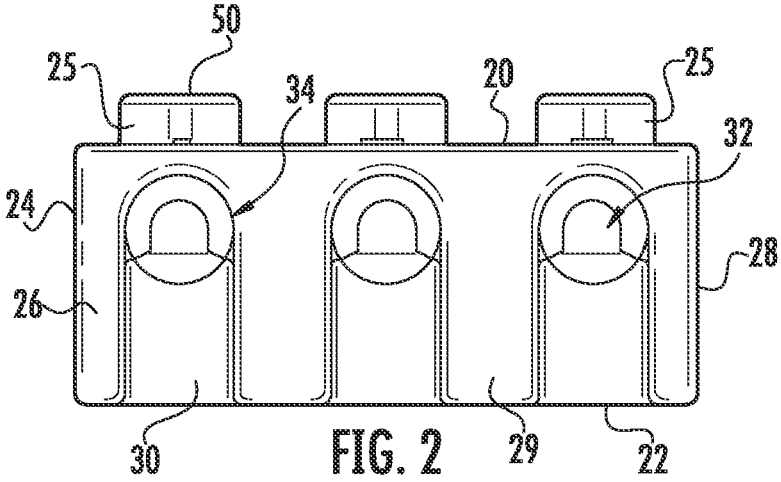
FIG. 2 is an end view of the connector embodiment of FIG. 1.

Exemplary embodiments of a wire-to-wire electrical connector 10 according to aspects of the invention are illustrated in the figures. The electrical connector 10 is configured for connecting the conductive cores 14 of one or more pairs of wires 12, wherein the insulative sheath 16 has been stripped from the terminal ends of the wires 12. Referring particularly to FIGS. 1 and 2, the connector 10 includes a body member 18 formed from any conventional insulator material, for example a high temperature plastic material such as STANYL high temperature resistant nylon. The body member 18 can take on various shapes and sizes depending on its intended use, and in certain embodiments includes a top wall 20, bottom wall 22, side walls 24 and opposite longitudinal end walls 26. In the illustrated embodiments, the body member 18 is a generally box-shaped member defined by an upper shell member 28 and a mating lower shell member 30.

The body member 18 includes at least one connector position 34, which may be oriented between the end walls 26. For example, the connector 10 may include only one connector position 34 so that a single pair of wires 12 may be connected. Alternatively, as depicted in the illustrated embodiments, the connector 10 may be configured with multiple connector positions 34 to mate a plurality of wire pairs, as depicted by the 3-way connector 10 in FIGS. 6 and 7 wherein three pairs of wires 12 are electrically connected via the single connector 10. It should be readily appreciated that the connector 10 of the present invention is not be limited to a 1-way or a 3-way connector, and that any number of connector positions 34 may be included in a single connector 10.

Figure 4:
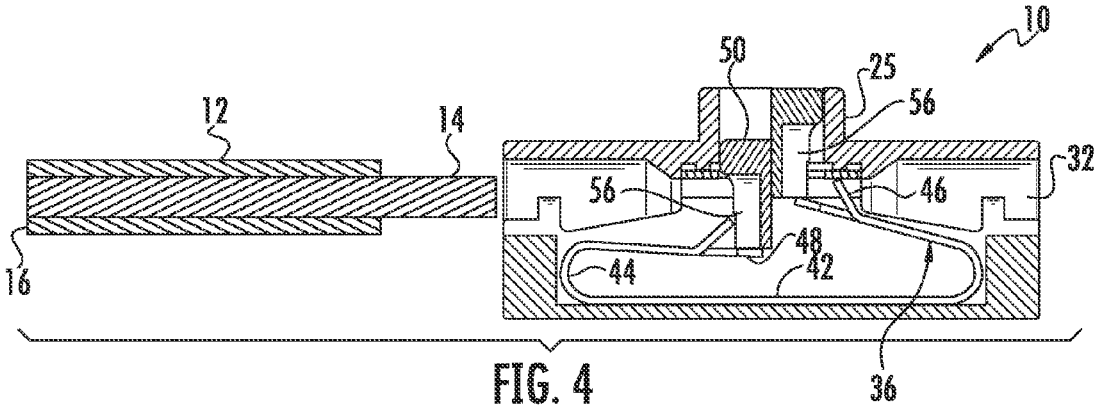
FIG. 4 is a side cut-away view of the connector of FIG. 3 configured for receipt of a wire therein.
Figure 5:
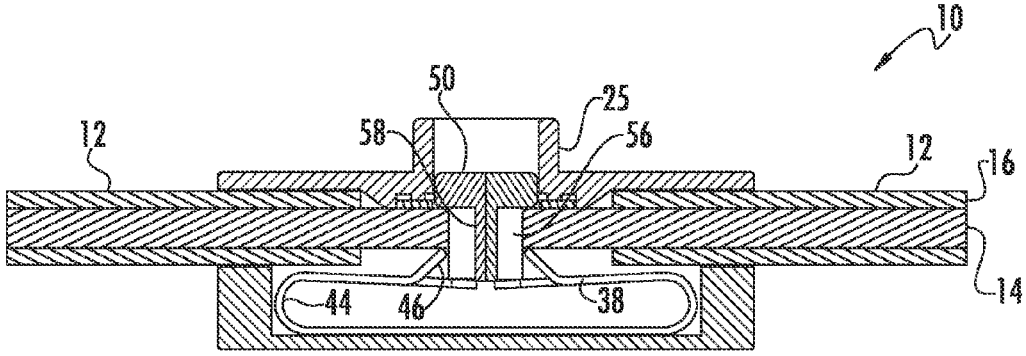
FIG. 5 is a side cut-away view of the connector of FIG. 3 with a pair of wires connected thereto.

Wire insertion openings 32 are defined in each of the end walls 26 of the body member 18 at each of the connector positions 34. The openings 32 are configured for receipt of the conductive core 14 of a particular gauge wire 12. Specifically, the openings 32 allow the conductive core 14 at a stripped end portion of the wire 12 to be inserted into the opening, and may accommodate a section of the sheath 16, as depicted in FIGS. 4 and 5. It should be appreciated that the size, depth, and configuration of the openings 32 may vary depending on the gauge of the wire 12.

Referring particularly to FIGS. 3 through 5, 8, and 9, a first contact element 36 is disposed at each of the connector positions 34. The contact elements 36 may be formed from any conventional conductive material, for example a conventional copper alloy material having any desired thickness. The contact elements 36 are fixed in the body member 18 by suitable means. For example, the contact elements 36 may be press fitted into recesses defined by walls 31 (FIGS. 8 and 9) or other retaining structure formed in the lower shell member 30 at each connector position 34, with the upper shell member 28 fitted over the lower shell member 30. Each of the contact elements 36 includes opposite end portions 38 that may be defined by bent over portions of an initially flat conductive strip. The bent over portions 38 extend from a bend 44 back over a bottom section 42 in a generally C-shaped configuration and define the biased sections of the contact element 36.

Figure 3:
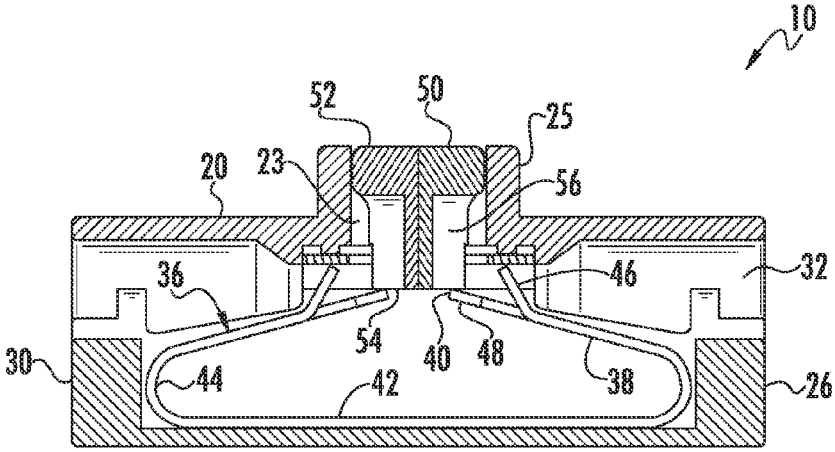
FIG. 3 is a side cut-away view of an embodiment of a connector in accordance with aspects of the invention.

A contact tab 46 is configured at each of the end portions 38. This tab 46 may, in one embodiment, simply be a section of the end portion 38, for example a section adjacent to the terminal end 40 (FIG. 3). In the illustrated embodiments, the contact tabs 46 are defined by cut-out portions of the end portion 38 that are angled away from the plane of the end portion 38, as particularly illustrated in FIGS. 3 through 5. In an alternate embodiment, the cut-outs may be in the terminal end 40 of the end portions 38 or spaced from the terminal ends. The cut-out tabs 46 that are angled above the plane of the end portions 38 provide an increased height to the tabs (relative to the bottom section 42) without increasing the angle (and height) of the end portions 38. The contact tabs 46 are biased to a closed position (FIG. 3) across the respective wire insertion opening 32. Thus, a desired degree of resiliency of the end portions 38 and overall minimum height of the body member 18 can be achieved.

An actuator 50 is configured with each wire insertion opening 32 such that a pair of the actuators 50 are associated with each connector position 34. The actuators 50 are movably displaceable through an opening 23 in a wall of the body 18

(e.g., the top wall 20 in the illustrated embodiment) and include a top end 52 (FIG. 3) and an opposite engagement end 54 in contact with a respective end portion 38 of the first contact element 36 in the biased, closed position of the element 36, as depicted in FIG. 3. In the illustrated embodiments, the pair of actuators 50 are configured adjacent to each other through a common opening 23 in the top wall 20.

A protective fence wall 25 surrounds the opening 23 through which the actuators 50 extend. This wall 25 has a sufficient height such that the actuators must be purposefully depressed below the wall 25 in order to move the contact elements 36 to an open position. The wall 25 thus prevents inadvertent actuation of the actuators 50. In other embodiments, the actuators 50 may be spaced apart and extend through separate openings 23 having separate fence walls 25. Ledges 60 defined on the engagement end 54 prevent the actuators from being pulled out of the body member 18 through the opening 23. The actuators 50 are depressible (manually or with a tool) by pushing on the top end 52 such that the opposite engagement end 54 moves the biased contact tab 46 to an open position for insertion of the conductive core 14 of a wire 12 into the wire insertion opening 32 beyond the contact tab 46, as shown in FIGS. 3 and 4. After the wire core 14 has been fully inserted, the actuator 50 is released and the contact tab 46 moves into biased engagement against the wire core 14, as illustrated in FIG. 5.

Figure 6:
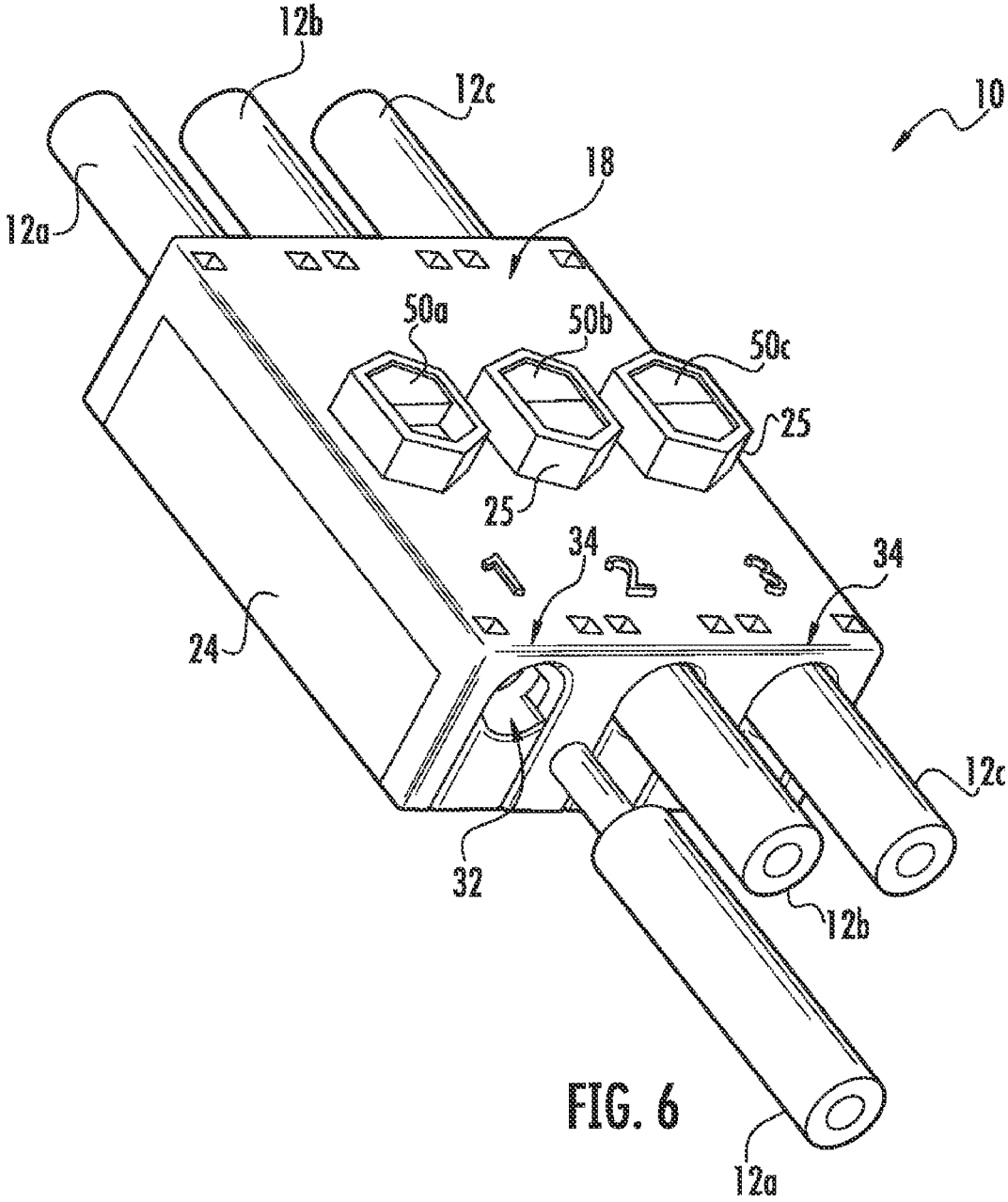
FIG. 6 is a perspective view of an embodiment of a multi-way connector illustrating actuation of a single actuator.

FIG. 6 depicts a 3-way connector 10 configured for interconnecting pairs of wires 12*a*, 12*b*, and 12*c*. Respective pairs of actuators 50*a*, 50*b*, and 50*c* are provided for the wire insertion openings associated with each connector position 34. One of the actuators 50*a* is depicted in the depressed state wherein the internal biased portion of the contact element 36 has been moved to allow for insertion of the wire 12*a* into the opening 32 so that that the conductive core 14*a* extends beyond the displaced contact tab. All of the other actuators 50*a*, 50*b*, and 50 are depicted in the "returned" state after their respective wires have been inserted.

Figure 7:
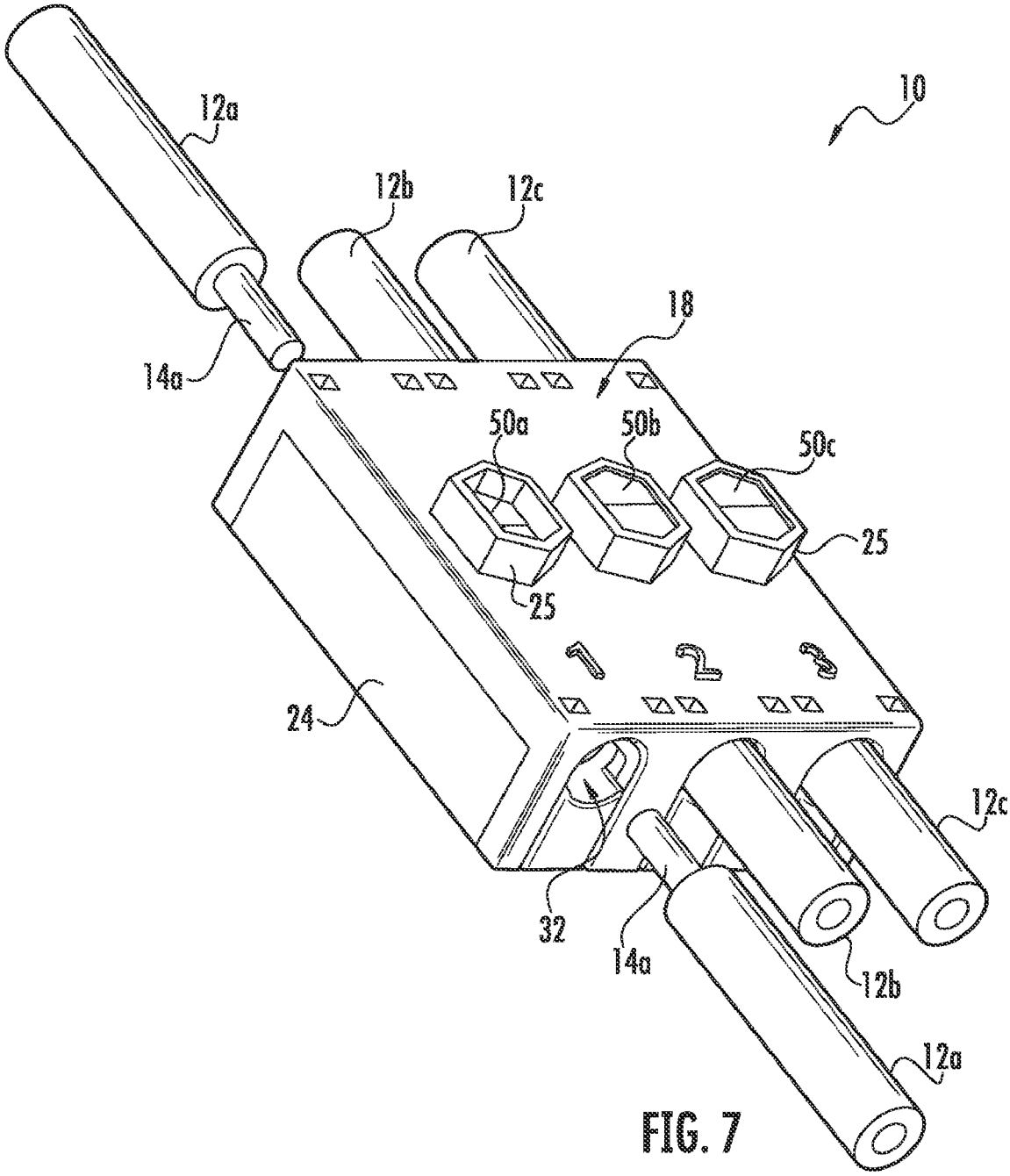
FIG. 7 is a perspective view of the connector of FIG. 6 illustrating actuation of the pair of actuators associated with a connector position.

Referring to FIG. 7, it should be appreciated that the sequence or number of actuators 50*a*, 50*b*, and 50 that may be operated at one time is not a limiting factor. FIG. 7 depicts both of the actuators 50*a* associated with the first connector position in the "open" state for simultaneous receipt of the pair of wires 12*a*.

Referring to FIGS. 3 through 5, the engagement end 54 of the actuators 50 may include a recess 56 defined therein for receipt of the terminal end of the wire conductive core 14 in the connected state of the wire 12 with the connector 10. The recess 56 may further define a stop surface 58 against which the terminal end of the conductive core 14 abuts in the connected state. Referring to FIG. 3, the contact tabs 46 initially block passage of the conductive core 14 until the actuator 50 is depressed and the engagement end 54 pushes down on an end section 48 of the biased end portion 48 of the contact element 36, as shown in FIG. 4. In this position, the recess 56 aligns coaxially with the insertion opening 32 so that the conductive core 14 is able to move past the contact tab 46 and abut against the stop surface 58 (back wall of the recess 56). Once the actuator 50 is released, the bias force of the contact end portion 38 causes the contact tab 46 to engage and "grip" the core 14. The angle of the tab 46 generates a positive locking action on the core that prevents inadvertent withdrawal of the wire 12 from the connector 10 until the actuator 50 is again depressed to disengage the contact tab 46 from the core 14. The actuators 50 will remain in the depressed state as depicted in FIG. 5 until subsequently depressed further to release the wires 12, upon which the actuators 50 will return to the position shown in FIG. 3.

The connector 10 may further include a second contact element 62 fixed in the body member 18 at each connector position 34 to provide a redundant electrical connection between the conductive cores 14 of the wires 12. In the illustrated embodiments, this second contact element 62 is disposed so as to bridge between the contact tabs 46 of the first contact element 36. The second contact elements 62 are particularly visible in the component views of FIGS. 8 and 9. The second contact elements 62 include an opening 64 that accommodates movement of the actuators 50 through the element 62, as seen in FIGS. 3 through 5. With this embodiment, in the closed position, the contact tabs 46 are biased against end portions 66 of the second contact element 62. In the connected state, the wire conductive cores 14 are pressed into conductive contact with the end portions 66, with the second contact element 62 thereby providing a redundant conductive path between the opposite wires 12.

Figure 9:
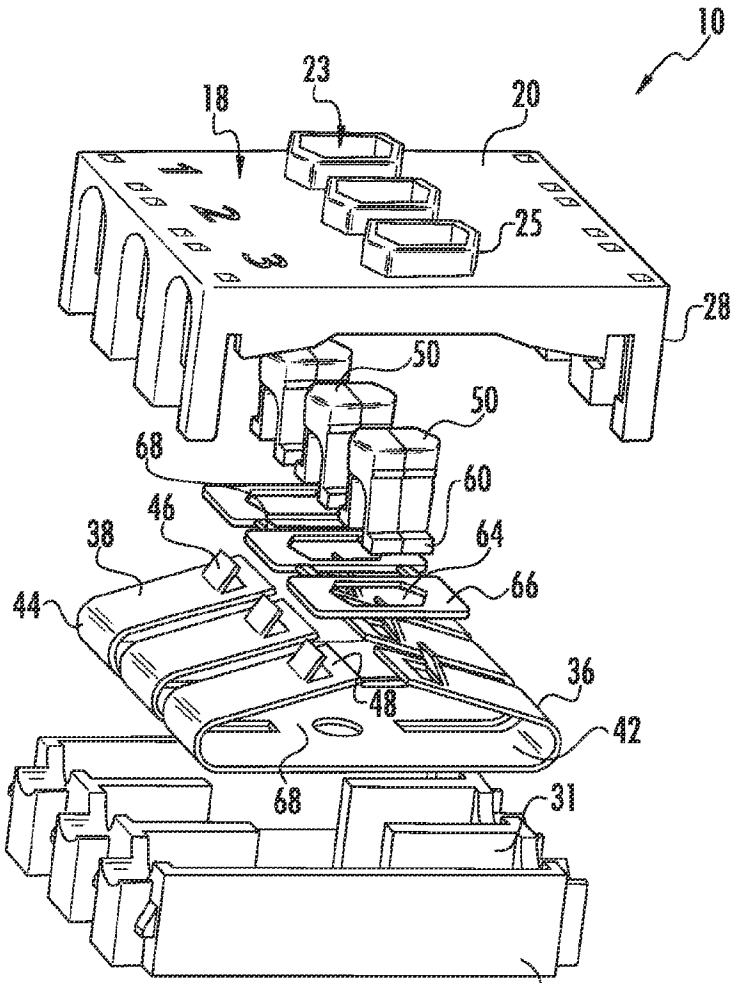
FIG. 9 is a component view of an alternate embodiment of a multi-way connector configured as a shorting block.
Figure 8:
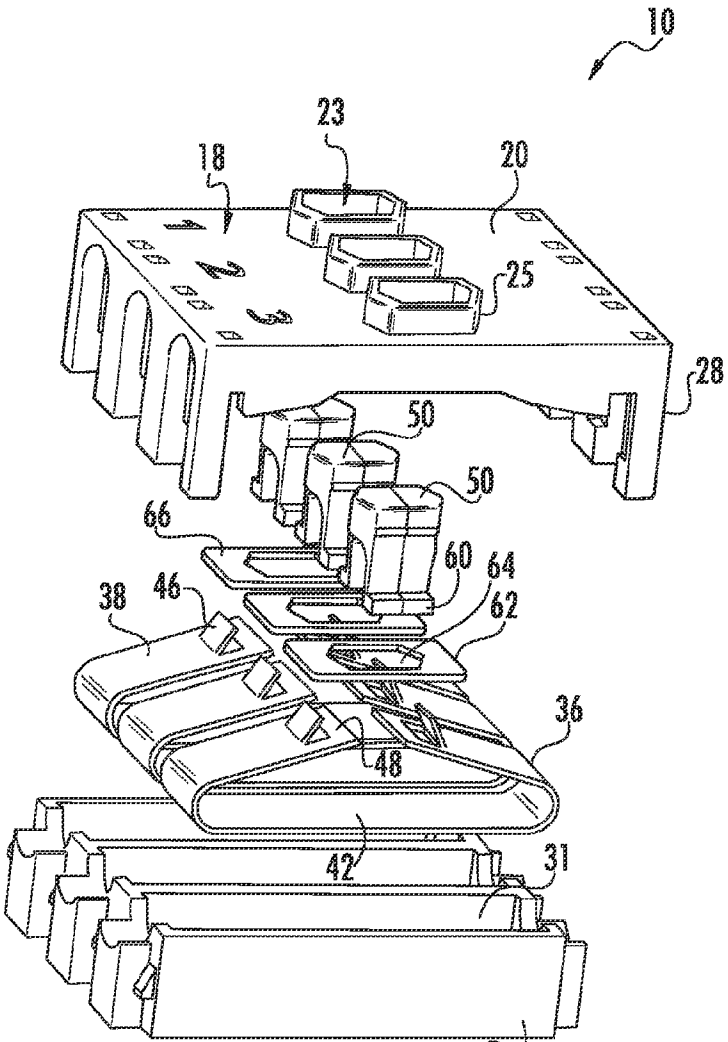
FIG. 8 is a component view of an embodiment of a multi-way connector in accordance with aspects of the invention.

As discussed (and referring to FIG. 8), the connector 10 may be configured as a multi-way connector with the plurality of first contact elements 36 electrically isolated from each other within the body 18 such that multiple pairs of connected wires are isolated from each other. Referring to FIG. 9, in an alternative embodiment, the connector 10 may be configured as a shorting block wherein the plurality of first contact elements 36 and second contact elements 62 are electrically shorted together with shorting bridges 68. With this configuration, any one wire 12 connected to the connector 10 is electrically connected to all other wires 12 electrically connected to the connector 10.

It should be readily appreciated by those skilled in the art that various modifications and variations can be made to the embodiments of the invention illustrated and described herein without departing from the scope and spirit of the invention. It is intended that such modifications and variations be encompassed by the appended claims.

What is claimed is:

1. A wire-to-wire electrical connector configured for connecting wires in an end-to-end configuration, said connector comprising:

an insulative body member comprising top and bottom walls, opposite end walls, and an internal connector position disposed between said end walls;

a wire insertion opening defined in each of said end walls;

a first contact element disposed in said connector position coaxial with said wire insertion openings, said first contact element comprising opposite end portions with a respective contact tab configured thereon, said contact tabs biased to a closed position across said respective wire insertion opening;

an actuator configured with each said wire insertion opening, said actuators movably displaceable through an opening in a wall of said body member and further comprising an engagement end in contact with a respective end portion of said first contact element;

wherein said actuators are manually depressible to move said contact tabs to an open position for insertion of a conductive core of a wire into said wire insertion opening beyond said contact tab, whereby upon release and return of said actuators, said contact tabs are biased against the conductive core of opposite wires; and said first contact element comprising a generally C-shaped member with an elongated bottom section and bent over end portions, said contact tabs defined adjacent to terminal ends of said bent over end by angled cut-outs of said bent over end portions that extend at an angle above a plane of said bent over end portion.

2. The connector as in claim 1, wherein said engagement end of said actuators engage said first contact element adjacent to said angled cut-outs.

3. The connector as in claim 2, wherein said engagement end of said actuators comprises a recess for receipt of the conductive core of the wire in the connected state with said connector, said recess defining a stop surface against which a terminal end of the conductive core of the wire abuts in the connected state.

4. The connector as in claim 1, wherein said contact tabs block passage of the conductive core of the wire further into said wire insertion opening until moved to a position below the conductive core upon depression of said respective actuator.

5. The connector as in claim 1, further comprising a second contact element fixed in said body member at said connector position, said second contact element bridging between said contact tabs of said first contact element such that in said closed position, said contact tabs are biased against said second contact element.

6. The connector as in claim 5, wherein in the connected state, the conductive core of the wires are in conductive contact with said second contact element, said second contact element thereby providing a redundant conductive path between the opposite wires.

7. The connector as in claim 1, wherein said connector is configured as a multi-way connector with a plurality of said first contact elements and associated said wire insertion openings and actuators, whereby multiple pairs of wires may be connected via said connector.

8. The connector as in claim 7, wherein said plurality of first contact elements are electrically isolated from each other.

9. The connector as in claim 7, wherein said plurality of first contact elements are electrically shorted together such that any one wire connected to said connector is electrically connected to all other wires connected to said connector.

10. The connector as in claim 9, further comprising a plurality of second contact elements fixed in said body member at said connector positions, said second contact elements bridging between said contact tabs of said first contact elements such that in said closed position, said contact tabs are biased against said second contact element, and wherein in the connected state, the conductive core of the wires are in conductive contact with said second contact elements, said second contact elements also electrically shorted together.

11. The connector as in claim 1, wherein said body member comprises an upper shell member and a lower shell member, said first contact elements pressed into said lower shell member.

12. The connector as in claim 1, further comprising a fence wall surrounding said opening in said wall through which said actuators are depressed, said fence wall having a height relative to said wall such that said actuators must be depressed below said fence wall to move said contact tabs to the open position.

13. A wire-to-wire electrical connector configured for connecting wires in an end-to-end configuration, said connector comprising:

an insulative body member comprising top and bottom walls, opposite end walls, and an internal connector position disposed between said end walls;

a wire insertion opening defined in each of said end walls;

a first contact element disposed in said connector position coaxial with said wire insertion openings, said first contact element comprising opposite end portions with a respective contact tab configured thereon, said contact tabs biased to a closed position across said respective wire insertion opening;

an actuator configured with each said wire insertion opening, said actuators movably displaceable through an opening in a wall of said body member and further comprising an engagement end in contact with a respective end portion of said first contact element;

said actuators manually depressible to move said contact tabs to an open position for insertion of a conductive core of a wire into said wire insertion opening beyond said contact tab, whereby upon release, said actuators move to a return position with said contact tabs biased against the conductive core of opposite wires; and said actuators configured to remain in contact with said respective end portion of said first contact element in said return position whereby the conductive core of a wire inserted into said wire insertion opening is released by subsequent depression of said actuators and disengagement of said contact tab from the conductive core of the wire; and wherein said contact tabs are defined by angled cut-outs at terminal ends of said first contact element, said engagement end of said actuators engaging said first contact element adjacent to said angled cut-outs.

14. A wire-to-wire electrical connector configured for connecting wires in an end-to-end configuration, said connector comprising:

an insulative body member comprising top and bottom walls, opposite end walls, and an internal connector position disposed between said end walls;

a wire insertion opening defined in each of said end walls;

a first contact element disposed in said connector position coaxial with said wire insertion openings, said first contact element comprising opposite end portions with a respective contact tab configured thereon, said contact tabs biased to a closed position across said respective wire insertion opening;

an actuator configured with each said wire insertion opening, said actuators movably displaceable through an opening in a wall of said body member and further comprising an engagement end in contact with a respective end portion of said first contact element;

said actuators manually depressible to move said contact tabs to an open position for insertion of a conductive core of a wire into said wire insertion opening beyond said contact tab, whereby upon release, said actuators move to a return position with said contact tabs biased against the conductive core of opposite wires; and said actuators configured to remain in contact with said respective end portion of said first contact element in said return position whereby the conductive core of a wire inserted into said wire insertion opening is released by subsequent depression of said actuators and disengagement of said contact tab from the conductive core of the wire; and wherein said engagement end of said actuators comprises a recess for receipt of the conductive core of the wire in the connected state with said connector, said recess defining a stop surface against which a terminal end of the conductive core of the wire abuts in the connected state.

15. The connector as in claim 14, further comprising a second contact element fixed in said body member at said connector position, said second contact element bridging between said contact tabs of said first contact element such that in said closed position, said contact tabs are biased against said second contact element.

16. The connector as in claim 14, wherein said connector is configured as a multi-way connector with a plurality of said first contact elements and associated said wire insertion openings and actuators, whereby multiple pairs of wires may be connected via said connector.

17. The connector as in claim 16, further comprising a plurality of second contact elements fixed in said body member at said connector positions, said second contact elements bridging between said contact tabs of said first contact elements such that in said closed position, said contact tabs are biased against said second contact element, and wherein in the connected state, the conductive core of the wires are in conductive contact with said second contact elements, said second contact elements also electrically shorted together.

18. The connector as in claim 14, further comprising a fence wall surrounding said opening in said wall through which said actuators are depressed, said fence wall having a height relative to said wall such that said actuators must be depressed below said fence wall to move said contact tabs to the open position.

* * * * *